US009967652B2

(12) United States Patent
Baird et al.

(10) Patent No.: US 9,967,652 B2
(45) Date of Patent: May 8, 2018

(54) COAXIAL LOUDSPEAKER APPARATUS

(71) Applicant: MARTIN AUDIO LIMITED, High Wycombe, Buckinghamshire (GB)

(72) Inventors: Jason Baird, London (GB); Philip Anthony, Marlow (GB); Matthew Spandl, Wheatley (GB)

(73) Assignee: Martin Audio Limited (GB)

( * ) Notice: Subject to any disclaimer, the term of this patent is extended or adjusted under 35 U.S.C. 154(b) by 12 days.

(21) Appl. No.: 15/305,921

(22) PCT Filed: Apr. 23, 2015

(86) PCT No.: PCT/GB2015/051205

§ 371 (c)(1),
(2) Date: Oct. 21, 2016

(87) PCT Pub. No.: WO2015/162432

PCT Pub. Date: Oct. 29, 2015

(65) Prior Publication Data

US 2017/0048610 A1 Feb. 16, 2017

(30) Foreign Application Priority Data

Apr. 23, 2014 (GB) ..... 1407171.6

(51) Int. Cl.
*H04R 1/02* (2006.01)
*H04R 1/24* (2006.01)
(Continued)

(52) U.S. Cl.
CPC ..... *H04R 1/24* (2013.01); *H04R 1/30* (2013.01); *H04R 1/26* (2013.01); *H04R 9/063* (2013.01)

(58) Field of Classification Search
CPC ..... H04R 1/24; H04R 1/26; H04R 9/063
See application file for complete search history.

(56) References Cited

U.S. PATENT DOCUMENTS 2,761,913 A * 9/1956 Manley ..... H04R 1/24 381/420
4,475,014 A * 10/1984 King ..... H01L 41/29 381/186

(Continued)

FOREIGN PATENT DOCUMENTS

GB 2139040 A 10/1984

OTHER PUBLICATIONS

International Search Report and Written Opinion for PCT/GB2015/051205, dated Sep. 4, 2015; ISA/EP.

(Continued)

*Primary Examiner* — Brian Ensey
(74) *Attorney, Agent, or Firm* — Harness, Dickey & Pierce, P.L.C.

(57) ABSTRACT

A coaxial loudspeaker apparatus (10) comprising a first unit (20) being arranged to propagate sound in a first frequency range; a second unit comprising a first waveguide (30) arranged to propagate sound in a second frequency range that is higher than the first frequency range, and a second waveguide (60) arranged to move, during operation, relative to the first waveguide (30); wherein the second waveguide (60) extends substantially in prolongation of the first waveguide (30). The invention also extends to a loudspeaker (190) incorporating the coaxial loudspeaker apparatus (10).

20 Claims, 13 Drawing Sheets

(51) Int. Cl.

| | |
|---|---|
| ***H04R 1/30*** | (2006.01) |
| *H04R 1/26* | (2006.01) |
| *H04R 9/06* | (2006.01) |

(56) References Cited

U.S. PATENT DOCUMENTS

| | | | | |
|---|---|---|---|---|
| 4,619,342 | A * | 10/1986 | Buck | H04R 9/063 381/342 |
| 2010/0272295 | A1 | 10/2010 | Nakatani | |
| 2011/0069857 | A1 | 3/2011 | Miller et al. | |
| 2013/0064414 | A1 | 3/2013 | Flavignard et al. | |
| 2013/0142379 | A1 | 6/2013 | Varla et al. | |
| 2014/0286524 | A1 * | 9/2014 | Robineau | H04R 1/24 381/412 |

OTHER PUBLICATIONS

Search Report of the Great Britain Priority Application No. 1407171.6 dated Sep. 26, 2014.

* cited by examiner

10

COAXIAL LOUDSPEAKER APPARATUS

The present invention relates to a loudspeaker apparatus and, in particular, to so called 'coaxial' loudspeakers.

A coaxial loudspeaker design offers a compact acoustic arrangement that improves system directivity through the crossover region, by avoiding the off-axis phase cancellation that occurs with discrete, axially offset acoustic sources.

However, it is recognised that coaxial loudspeakers often suffer from a compromised directivity pattern (acoustic response off-axis) across their frequency spectrum. In particular, when a conventional, axisymmetric cone shape is used as the low/mid-frequency part of the coaxial loudspeaker arrangement, the directivity of the high-frequency section is compromised because the axisymmetric low/mid-frequency cone forms the walls of a horn within which the high-frequency sound waves propagate, so an axisymmetric directivity pattern is imposed upon the high-frequency acoustic output. This axisymmetric directivity pattern is generally not optimal for professional loudspeakers. Also, because the angle of the cone neck must be steep in order to ensure good low/mid-frequency performance, the axisymmetrical high frequency directivity pattern often has a beamwidth which decreases with increasing frequency, further compromising the design.

It is an aim of the present invention to alleviate at least some of the aforementioned problems. In particular, it is an aim of the present invention to improve the directivity of coaxial loudspeakers, whilst maintaining compactness, and without introducing further effects that might act to impair acoustic performance (such, for example, as occluding acoustically active elements of the loudspeaker (the low/mid-frequency cone) or diffusing sound in a rudimentary and uncontrolled manner, such as in certain circumstances when a high-frequency speaker is arranged upstream and co-axially to a low/mid-frequency speaker).

According to one aspect of the invention, there is provided a coaxial loudspeaker apparatus comprising: a first unit (preferably a low/mid-frequency unit) being arranged to propagate sound in a first frequency range; and a second unit (preferably a high-frequency unit) comprising a first waveguide arranged to propagate sound in a second frequency range that is higher than the first frequency range, and a second waveguide arranged to move, during operation, relative to the first waveguide; wherein the second waveguide extends substantially in prolongation of the first waveguide. Preferably, only a first and second unit is provided.

The acoustic performance of at least the second unit may thereby be improved by the second waveguide, but without detriment to the performance of the first unit.

For optimum performance, and preferably as though a single waveguide were present, preferably the second waveguide extends substantially continuously (that is, preferably with substantially no discontinuity, either in terms of a gap between the first and second waveguides and/or a discontinuity in curvature between the first and second waveguides) from the first waveguide, preferably when the first unit is at rest.

Preferably, the first unit and the second unit each comprise a sound-reproducing or sound-radiating member (such as a membrane, cone, diaphragm, or the like). Preferably, the sound-reproducing or sound-radiating member of the second unit is arranged downstream of the sound-reproducing or sound-radiating member of the first unit.

Suitably, the second waveguide may be arranged to move in unison with the first unit, preferably when the coaxial loudspeaker apparatus is in operation, so that the movement of the first unit is not impaired.

In order to prevent acoustic occlusion, the first waveguide may be arranged downstream of the second waveguide and/or the first unit may be arranged downstream of the second unit.

Preferably, the second waveguide is separate from the first waveguide, preferably in that it is not coupled to the first waveguide in order to facilitate unencumbered movement of the second waveguide with the first unit.

Preferably, the second waveguide is attached to the first unit via a compliant joint or is attached to the first unit by means of glue.

The second waveguide may be compliantly coupled to the first waveguide. The second unit may comprise a compression driver, horn, dome and/or cone.

In order to channel sound, in particular to channel sound from the first waveguide to the second waveguide, preferably the first waveguide comprises a mouth located at a junction with the second waveguide; a throat located acoustically upstream; and a passage extending between the mouth and the throat.

For efficiency, the passage may have a narrower area towards the throat than towards the mouth.

Preferably, the passage comprises two opposing substantially parallel walls and two opposing flared walls. Preferably, the throat is substantially rectangular, preferably with rounded corners.

In order to improve the acoustic performance of the second unit, preferably the second waveguide is arranged to extend the shape of the first waveguide, preferably wherein the first waveguide is a horn.

For acoustic performance, preferably the second waveguide has a rounded peak; preferably the second waveguide is substantially domed for structural integrity.

The second waveguide may be substantially oval-shaped, but preferably with a tapered or inwardly curving side. Preferably, the tapered or inwardly curving side of the second waveguide forms the junction with the first waveguide so that the second waveguide is a continuation of substantially the entire first waveguide at the junction.

So that the presence of the second waveguide is of minimal or no detriment to the first unit, the second waveguide may be less dense than the moving parts (preferably the cone) of the first unit (wherein the "moving parts" preferably refers to the voice-coil, former, (inner) suspension, cone and outer suspension (also referred to as the "surround"), or it may be of equal or substantially comparable density (preferably, within ±25% and more preferably within ±10%) to the first unit.

Suitably, the second waveguide and/or first unit may be formed from paper, fibreglass, fabric and/or composite materials. So as to dampen in-band modes, preferably the second waveguide is formed from a pulped material, preferably pulped paper.

Preferably, the material forming the second waveguide and/or first unit is doped with a dopant, preferably where the dopant is a synthetic or natural fibre; resin; or epoxy.

Suitably, for efficiency, the material forming the second waveguide may be uneven in thickness and/or the amount of dopant applied to the second waveguide is uneven throughout the second waveguide.

For structure and efficiency, preferably the thickness of the material forming the second waveguide and/or the amount of dopant applied to the second waveguide is higher proximate to the junction with the first waveguide and/or at the peak of the second waveguide than elsewhere throughout the second waveguide. Where the first unit comprises a cone, preferably the thickness of the material forming the second waveguide is thinner than the material forming the cone.

Preferably, the stiffness of the second waveguide is set such that the vibrational modes of the second waveguide are above the operating vibrational modes of the first unit, for example so that the break-up mode of the second waveguide is approximately half an octave to twice an octave above that of the first unit.

Preferably there are at least two second waveguides and preferably the at least two second waveguides are located around the first waveguide. In order to achieve differential acoustic dispersion, the at least two second waveguides may be arranged asymmetrically or axisymmetrically and/or have different shapes relative to one another; they may however be symmetrical one with another or be arranged symmetrically.

Preferably, the at least two second waveguides are arranged on an axis that bisects the first unit and/or the mouth; preferably the at least two second waveguides are arranged either side of the first waveguide.

For suitable effectiveness, preferably the second waveguide extends from its junction with the first waveguide to a point at least 50%, and more preferably at least 80% or 90%, of the radius of the first unit (preferably, where the first unit comprises a cone, the term "radius" refers to half the distance of the overall diameter of the base of the cone).

Preferably, the coaxial loudspeaker apparatus further comprises a rigid frame, preferably to which the first unit is compliantly bonded, preferably by means of a surround and/or suspension. The coaxial loudspeaker apparatus may further comprise a driver unit, voice-coil, magnet and/or former.

Preferably, the radius of the first unit is 3 cm-25 cm; more preferably the radius of the first unit is 5 cm-16 cm. Preferably, the diameter of the first unit is 6 cm-50 cm; more preferably the diameter of the first unit is 10 cm-32 cm.

For efficiency, preferably the second waveguide is formed as an integral part of the first unit. Suitably, the first unit may have a radius no greater than 5 cm-7.5 cm (and preferably a diameter no greater than 10 cm-15 cm) and the second waveguide is formed as an integral part of the first unit.

Preferably, the first unit has a substantially, preferably truncated, conic, convex or concave shape (preferably, including any curved conic shape).

To prevent occlusion of acoustically active parts, preferably an outer surface of the first waveguide, adjoining an inner surface of the second waveguide, is cylindrical, whereby the first waveguide does not occlude the first unit.

Preferably, the second waveguide has a mass that is less than 30%, preferably less than 20% and more preferably less than 10% of the mass of the moving parts of the first unit, wherein the "moving parts" preferably refers to the voice-coil, former, (inner) suspension, cone and outer suspension (also referred to as the "surround").

Preferably, the first waveguide and/or the second waveguide are shaped to form a constant directivity horn in order to improve the high-frequency output.

The first unit may be arranged to propagate sound up to a frequency of 20 Hz-6,000 Hz, and preferably 60 Hz-4,000 Hz. The first waveguide may be arranged to propagate sound at a frequency of up to 0.5 kHz-25 kHz, and preferably at 1.5 kHz-20 kHz.

In order to achieve the desired acoustic dispersion, preferably the shape of the first waveguide and/or the second waveguide is adapted to output a differential acoustic dispersion pattern, preferably wherein the pattern of output sound is substantially a rectangular plane parallel to the downstream axis.

For differential acoustic dispersion, preferably the first waveguide and/or the second waveguide is non-symmetric, preferably about an axis downstream from the coaxial loudspeaker apparatus.

Preferably, the first waveguide is arranged to disperse sound in at least one particular first direction, preferably the second waveguide is arranged to disperse sound in at least one particular second direction, and preferably said second direction is the same as said first direction; preferably said first and/or said second directions are off-axis and/or perpendicular to the downstream direction/axis.

Suitably, the passage may have a narrower portion and a wider portion, preferably in a plane substantially perpendicular to the downstream axis, so as to achieve differential acoustic dispersion.

Preferably, the second unit is arranged to propagate sound to a first location acoustically downstream of the first unit and wherein the second waveguide is arranged to extend from the first waveguide, at the first location, to a second location, downstream from the first location, on the first unit.

Preferably, in order to achieve wide acoustic directivity at high frequencies, a tangent upon the second waveguide is inclined at an angle, relative to the downstream axis, no less than an angle, relative to the downstream axis, of a tangent upon the most upstream point of the first unit.

Preferably, the tangent upon the second waveguide is inclined at substantially less than 90 degrees.

In order to define a suitable horn, preferably the distance between the points where each of the at least two second waveguides meet the first unit in the downstream direction is preferably two to six, and more preferably three to four, times the diameter of the mouth.

The invention extends to a loudspeaker incorporating the above described coaxial loudspeaker apparatus. Preferably, the loudspeaker includes a cabinet or enclosure.

According to a further aspect of the invention there is provided a coaxial drive unit comprising a low/mid-frequency cone; and a waveguide, wherein the frontal shape of the low/mid-frequency cone is modified either by the addition of the waveguide or by direct modification of the cone geometry, in order to prescribe a desired acoustic coverage pattern (directivity). Preferably, the coaxial drive unit further comprises a stationary horn which along with the waveguide defines the desired high-frequency directivity.

Further features of the invention are characterised by the dependent claims.

The invention extends to any novel aspects or features described and/or illustrated herein.

The invention extends to methods and/or apparatus substantially as herein described and/or as illustrated with reference to the accompanying drawings.

The invention also provides a computer program and a computer program product for carrying out any of the methods described herein and/or for embodying any of the apparatus features described herein, and a computer readable medium having stored thereon a program for carrying out any of the methods described herein and/or for embodying any of the apparatus features described herein. The invention also provides a signal embodying a computer program for carrying out any of the methods described herein and/or for embodying any of the apparatus features described herein, a method of transmitting such a signal, and a computer product having an operating system which supports a computer program for carrying out any of the methods described herein and/or for embodying any of the apparatus features described herein.

Any apparatus feature as described herein may also be provided as a method feature, and vice versa. As used herein, means plus function features may be expressed alternatively in terms of their corresponding structure, such as a suitably programmed processor and associated memory.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

In this specification the word or can be interpreted in the exclusive or inclusive sense unless stated otherwise.

Furthermore, features implemented in hardware may generally be implemented in software, and vice versa. Any reference to software and hardware features herein should be construed accordingly.

The invention extends to a coaxial loudspeaker apparatus, or a loudspeaker, substantially as herein described with reference to the accompanying drawings.

The present invention is now described, purely by way of example, with reference to the accompanying diagrammatic drawings, in which:—

FIGS. 1-6 show various views of a coaxial loudspeaker apparatus 10 and/or in different states of operation.

Figure 1:
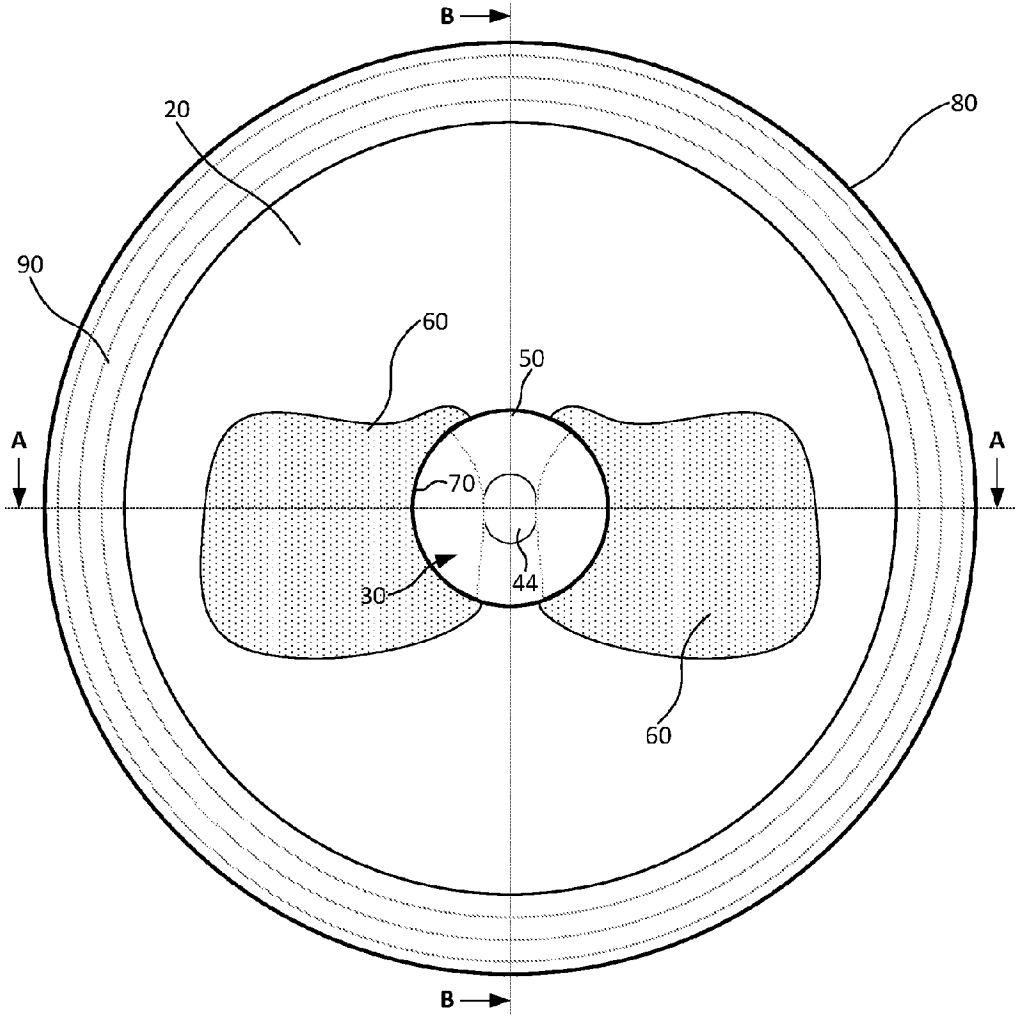
FIG. 1 shows a front view of a coaxial loudspeaker apparatus.

In FIG. 1, a front view of the coaxial loudspeaker apparatus 10 is shown, wherein the coaxial loudspeaker apparatus 10 comprises a low/mid-frequency unit in the form of a low/mid-frequency cone 20 or diaphragm; a high-frequency unit comprising a 'fixed' waveguide 30 coaxial to the low/mid-frequency cone 20; and a 'moving' waveguide 60.

Figure 2:
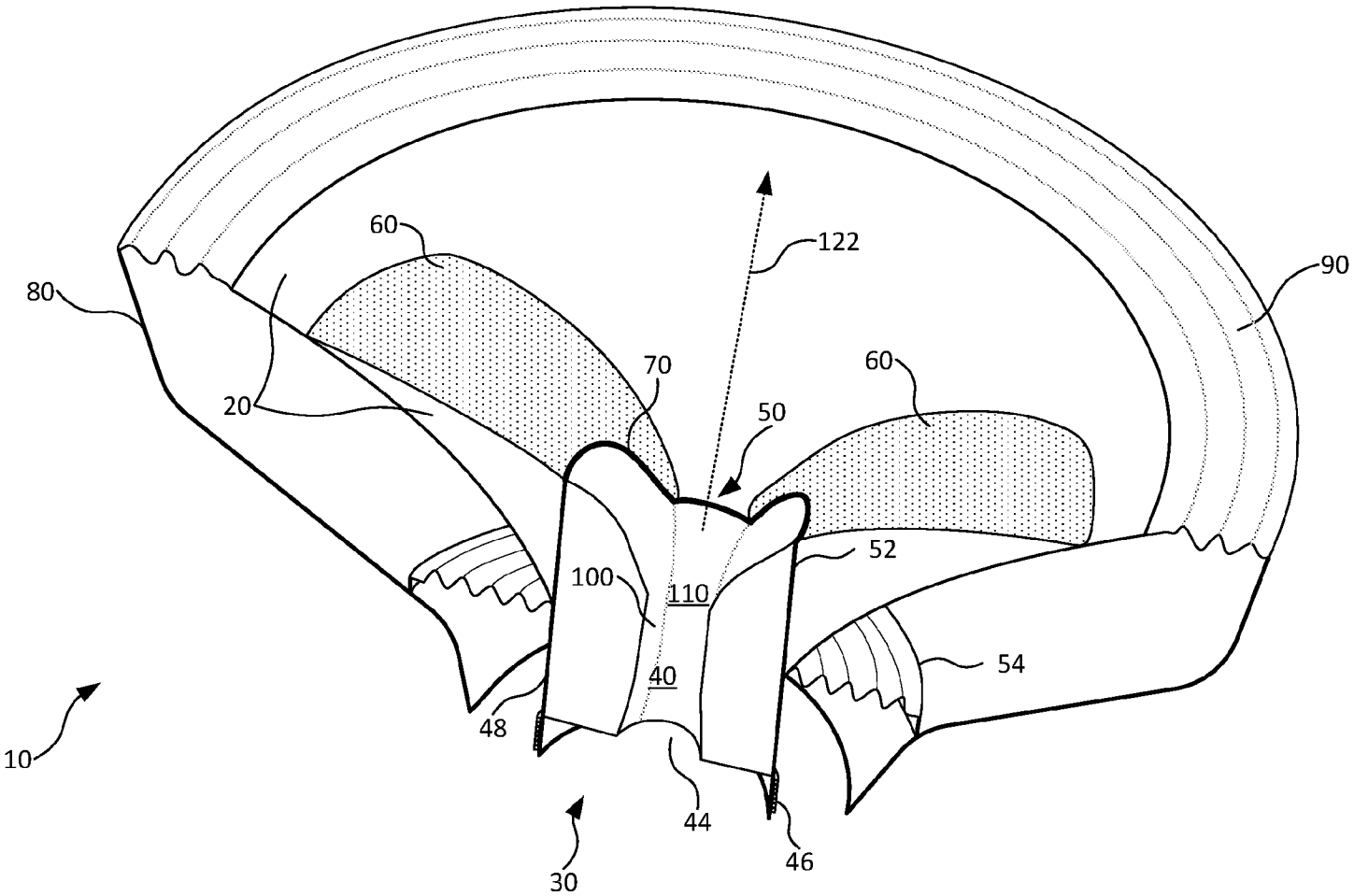
FIG. 2 is a perspective cross-section view of the coaxial loudspeaker apparatus.

A principal acoustic downstream direction 122 is shown in FIG. 2, and this term is used throughout preferably to refer to a direction in which sound propagates away from the front of the coaxial loudspeaker apparatus 10, wherein the axis of the downstream direction 122 is coaxial to the low/mid-frequency cone 20 (herein referred to as the "cone" 20) and fixed high frequency horn 30. The term "upstream direction" as used herein preferably opposes the downstream direction 122. The term "off-axis" preferably refers to points that are perpendicularly offset from the axis of the downstream direction 122.

In the example shown, the fixed waveguide of the high frequency unit is in the form of a fixed high frequency horn 30 adapted to propagate pressure waves in the form of sound in a higher frequency range than the low/mid-frequency unit.

In overview, the fixed high frequency horn 30 (herein referred to as the "horn" 30) extends from a throat 44 (as shown in FIGS. 2-6), via a passage 40, to a mouth 50. The throat 44 has a smaller area than the mouth 50 and is located at a distal end from both the mouth 50 and the cone 20. The horn 30 therefore defines a passage for channelling sound (in particular, sound in a higher frequency range than the sound reproduced by the cone 20, for example at 500 Hz-20 kHz, and more preferably at 1.5 kHz-20 kHz). The horn is shown as a differential acoustic dispersion horn 30 and is composed of fibreglass, plastic or aluminium.

The horn mouth 50 interfaces with the moving waveguides 60, at a junction 70, such that when the cone 20 is at rest there is substantially no discontinuity between the surface of the moving waveguide 60 and the horn 30. However, in use, when the cone 20 is vibrating the moving waveguide 60 moves together, preferably in unison, with the cone 20 whilst the horn 30 remains substantially at rest (as further described with reference to FIG. 5). The accordant motion of the moving waveguide 60 and cone 20 is achieved by coupling the moving waveguide 60 to the cone 20, for example by attaching the moving waveguide 60 to the cone 20 and a low/mid-frequency voice-coil former 48 for a low/mid-frequency voice-coil 46 via a moving waveguide support 52 (which in one embodiment is manufactured from fibreglass, though, alternatively, the separate waveguide support could be incorporated into the moving waveguide or into the voice coil former) or by forming the moving waveguide 60 into, or integrally with, the cone 20. The moving waveguide 60 can therefore be considered to be a 'moving' waveguide as, in use, it is non-static.

The moving waveguide 60 of the present embodiment is bonded to the conic surface of the cone 20 and the voice-coil former 48 (via the moving waveguide support 52) and is configured effectively to modify the shape of the frontal face of the cone 20 to achieve acoustic dispersion of the high frequency output of the loudspeaker apparatus 10, for example in the form of a prescribed pattern, whilst having a negligible or indeed beneficial effect on the acoustic performance of the cone 20 (and horn 30 also). The moving waveguides 60 and cone 20 can be considered to form a continuation of the horn 30 resulting in a larger single horn having a throat 44 and a mouth arranged where the moving waveguides 60 terminate downstream; at this point, this mouth is preferably as large as the cone 20, and suitably two to six times, and more preferably three to four times, the diameter of the mouth 50 of the horn 30.

The moving waveguide 60 is attached to the cone 20, with a compliant joint, in order to achieve a degree of decoupling of the moving waveguides from the cone 20 at the upper frequencies reproduced by the cone 20. The compliance of the joint between the moving waveguides 60 and the voice coil former 48, via waveguide support 52 may also be varied in order to modify the coupling between the voice-coil former 48 and moving waveguide 60 and hence modify the low/mid-frequency response and directivity. For example, the moving waveguide 60 may be coupled to the low/mid-frequency voice-coil former 48 with a stiff joint and coupled to the cone 20 via a compliant (soft and "lossy") joint. However, it will be appreciated that the moving waveguide 60 may be detached from, but loosely coupled to, the cone 20 or pivoted about an anchor point, on or around the perimeter of the mouth 50 of the horn 30 or to a point between the mouth 50 and the cone 20.

The geometry of the cone 20—or 'low/mid-frequency radiator'—is optimised for low- and mid-frequency performance (e.g. up to 20 Hz-6,000 Hz, and more preferably 60 Hz-4,000 Hz). The cone 20 is shown as a truncated (preferably, curved or, more preferably, concave) cone, which terminates at the low/mid-frequency voice coil former 48 or horn 30, at and/or below the mouth 50.

The cone 20 terminates at a cone mouth distally from the horn 30; around the perimeter of the cone mouth the cone 20 is anchored to a rigid frame or basket 80 via a surround 90 that is a compliant membrane.

The horn 30, which is defined by its walls (100 and 110), channels the propagating high frequency sound with the moving waveguides 60 serving to extend the walls of the horn. At rest, the horn profile 61 formed by the horn walls (100 and 110) and the profile of the moving waveguide 60 form a single, continuous and smooth profile with no step change—that is, there is continuity between the gradient of the profile of the horn walls 61 and profile of the moving waveguide 62. The prolongation of the surface of the horn walls and the surface of the moving waveguides thereby increases the effective length and the size of the mouth of horn 30. The moving waveguides 60 continue the shape of the passage 40 provided by the horn 30 beyond the cone 20 neck (preferably, referring to the point where the cone 20 terminates in the upstream direction at the voice-coil former 48). Diffraction effects are minimised by smoothly blending the moving waveguide 60 into the profile of the horn 61 and the profile of the cone 63 beneath the moving waveguide 60 and the effective size of the mouth of the horn 30 is increased in order to maintain pattern control to a lower frequency than the horn 30 would achieve alone. Because the angle subtended by the moving waveguides 60, $\alpha$ (preferably, defined as the inclination of the surface of the moving waveguide 60 relative to the axis of the downstream direction 122), is wider than the angle of the cone 20 neck, $\beta$ (preferably, describing the incline of a tangent upon the surface of the cone 20 substantially at a point proximate to the cone 20 neck), the moving waveguides 60 make it possible to achieve wider acoustic directivity at high frequencies. The loudspeaker apparatus 10 is arranged such that the inequality $\alpha>\beta$ is true; however, decreasing the angle at the cone 20 neck, $\beta$, directly has a detrimental effect upon the low/mid-frequency performance of cone 20 due to a reduction in geometric stiffness.

Two moving waveguides 60 are located either side of the mouth 50 of the horn 30, along a line that bisects the mouth 50. In more detail, each moving waveguide 60 is arranged such that it extends radially along the cone from the cone 20 neck to at least 50%, and more preferably 80%-90%, of the radius of the cone 20. The radius of the cone 20 may vary according to the nature of the audio installation, but will typically be 3 cm-25 cm, and more commonly 5 cm-16 cm. The moving waveguides 60 may be formed as an integral part of the cone 20, preferably where the cone has a radius no greater than 5 cm-7.5 cm.

The moving waveguide 60, when attached or coupled to the cone 20, is formed from a lightweight material in order to minimise inertial effects on the cone 20. The material used for the waveguide 60 is also suitably damped and may be less dense than the material used for the cone 20 or may be substantially equal in density to the material used for the cone 20 (preferably, within ±25%, or more preferably within ±10%).

Various materials are used to form the moving waveguides 60, including paper pulp, sealed fabric, metal foils, plastics or composite materials or those commonly used for loudspeaker cones. The waveguide material is doped (which is also used to refer to the application of resins, epoxies and lacquers) in order to improve the rigidity and/or internal damping (in order to induce mechanical losses) of the moving waveguide 60.

The mass of the moving waveguides 60 is sought to be kept to a minimum, but is typically approximately 5%-30%, and more preferably 7%-20%, of the mass of the moving parts (wherein the term "moving parts" is preferably used to refer to the voice-coil 46, voice-coil former 48, suspension 54, cone 20 and/or surround 90, and optionally includes any corresponding braids and glue) of the low/mid-frequency section of the coaxial loudspeaker apparatus 10.

For efficiency, the doping of the waveguide is applied unevenly across the moving waveguide 60, in order to increase rigidity where necessary without contributing too greatly to the mass of the moving waveguide 60. For example, the moving waveguide 60 is more heavily doped or resin impregnated towards the junction 70 of the moving waveguide 60 and the mouth 50 of the horn 30 to provide greater localised stiffness, or where the shape of moving waveguide 60 peaks in order to prevent collapsing. In addition, if the moving waveguide 60 is too stiff, then it will interfere with the natural breakup modes of the cone 20 (as well as the acoustic directivity and frequency response smoothness) and if too massive then the moving waveguide 60 significantly increases the mass of the moving parts of the low/mid-frequency section of the coaxial loudspeaker apparatus 10, reducing the sound pressure level reproduced by the cone and changing the low-frequency response shape for a given motor (that, for example, drives the low/mid-frequency unit)—the mass and stiffness of the moving waveguide 60 is therefore optimised according to these factors.

Figure 11A:
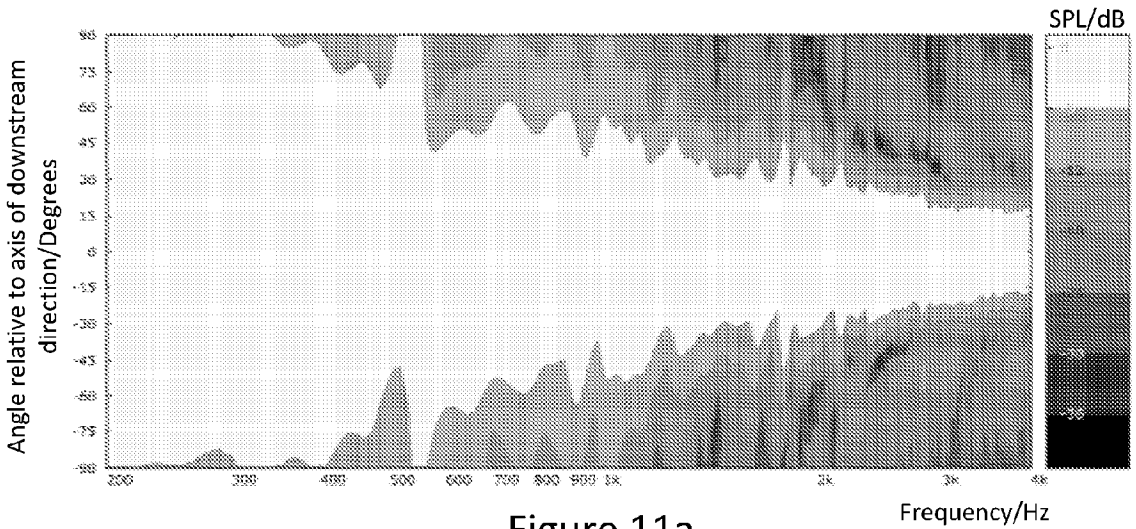
FIGS. 11 and 12 are plots of SPL response with axial angle comparing beamwidths of a low/mid-frequency unit of the coaxial loudspeaker apparatus and a loudspeaker arrangement known in the art.

The moving waveguide 60 is designed to minimise its effect on the operation of the cone 20 (as illustrated in FIG. 11), such as the desirable cone break-up (effectively decoupling the outer area of the cone 20 from the central area which reduces the piston diameter at high frequencies and increases the beamwidth of the output audio, compared to a rigid piston cone of the same size as the cone 20). The moving waveguide 60 is engineered to increase the horizontal directivity of the cone 20 beneficially by increasing the beam-width at the upper end of the cone's frequency range. This effect is improved by the addition of the moving waveguides 60, provided that the waveguide is rigid, lightweight and less dense (or at least such that any difference in density is small) than the cone 20.

FIG. 2 shows a cross-section of the loudspeaker apparatus 10 shown in perspective along the line "A" indicated in FIG. 1. The magnet assembly is not shown for conciseness.

Between the mouth 50 and throat 44 of the horn 30 a passage 40 is defined by two substantially conical-section, and preferably parallel and opposing, walls 100 meeting, preferably perpendicularly, two flared walls 110. The shape of the flare is such that the passage 40 expands in the downstream direction 122, and is defined by an iterative optimisation of the geometry of the passage 40 so as to achieve a desired acoustic directivity pattern from the horn 30 across specific frequencies. Alternatively, the flared walls 110 are defined by straight or curved lines (for example, concave, exponential or parabolic lines). The moving waveguide 60 is arranged to flare also so as to continue the flare of the walls 110 of the horn 30, in doing so a continuous surface is formed by the horn walls 110 and moving waveguide 60 that, in effect, acts as a single (horn) waveguide. The flare of the walls 110 of the horn 30 and or moving waveguide 60 does not exceed an angle of 90 degrees relative to the downstream direction 122.

The flared walls 110 of the horn 30 extend above the lowest point of the cone 20—the cone neck—though without obscuring the cone 20, thereby acting to provide acoustic dispersion of sound from the horn 30 towards and over the surface of the moving waveguide 60. Hence, the horn 30 extends, at most, up to a boundary extending from the cone 20 neck to the junction 70 of the moving waveguide 60 and horn 30 (in effect defining a cylindrical, or cylinder-like, boundary from an outer surface of the horn 30, adjoining an inner surface of the moving waveguide 60) whereby the horn 30 does not occlude the cone 20. Likewise, no part of the moving waveguides 60 crosses this boundary, but instead abuts the horn 30 along the junction 70.

The horn throat aperture 44 is not arranged directly below the horn mouth 50, but is instead offset to one side and/or is angled, such that sound diffracts through the passage 40 formed by the horn 30 (for example, so as to accommodate a compression driver that is offset and/or arranged at an angle relative to the horn 30); in this case the horn throat aperture 44 would not be visible when viewed from the perspective of FIG. 1. The horn throat aperture 44 takes a substantially rectangular shape, preferably where the corners of the rectangle are rounded. The horn throat aperture 44 is narrow so as to provide a small included angle for the horn 30.

Figure 3:
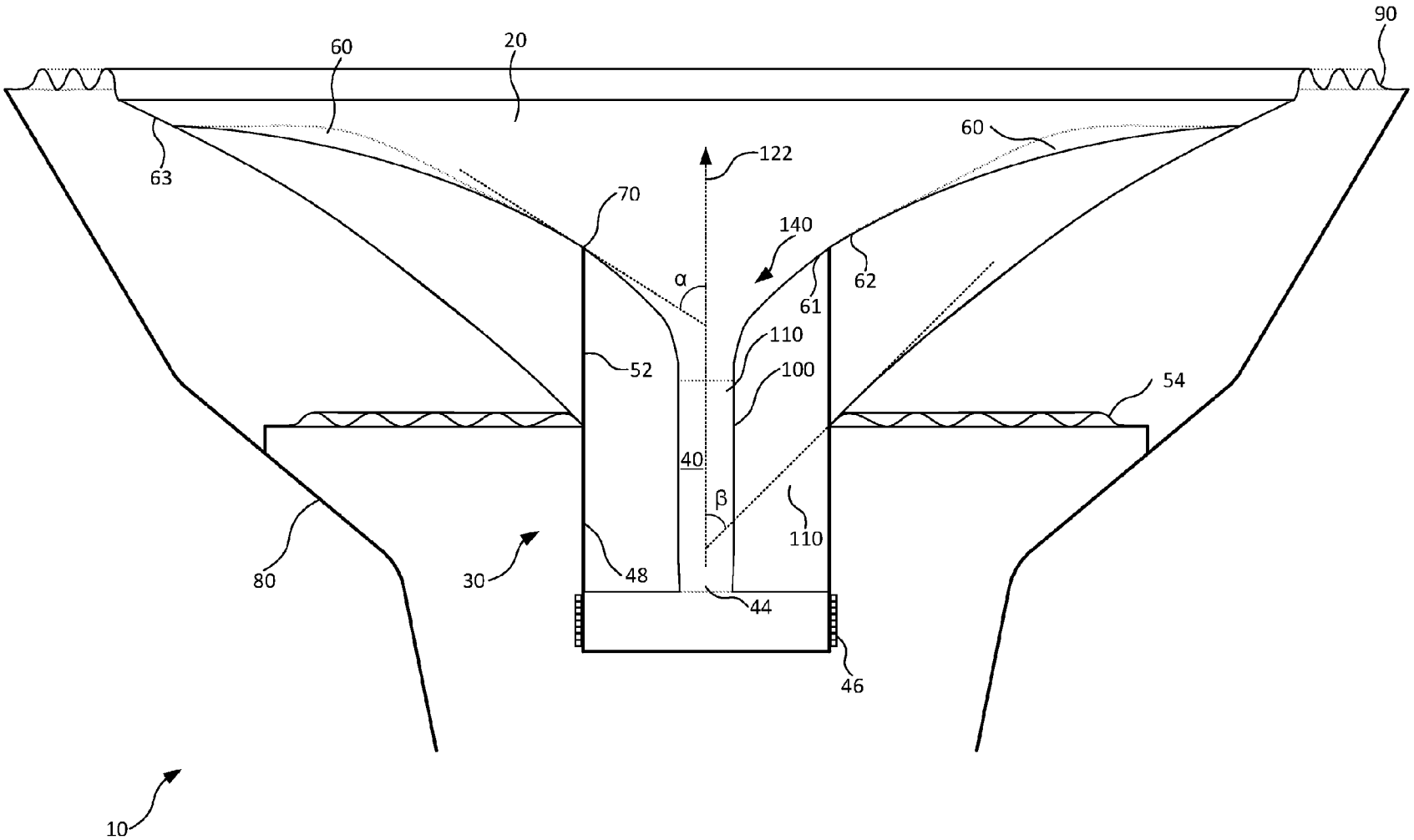
FIGS. 3-6 show cross-sections of the coaxial loudspeaker apparatus.
Figure 4:
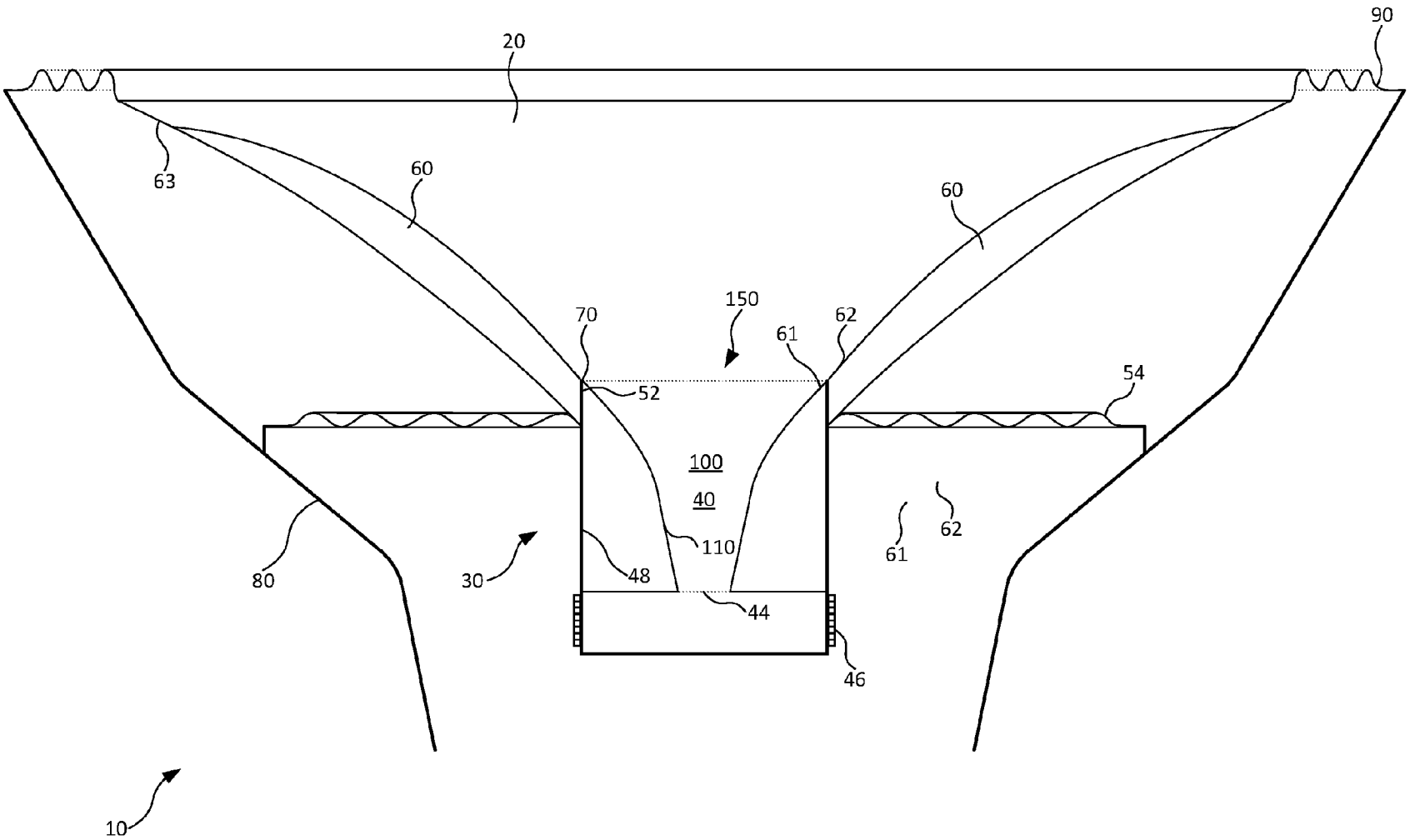

FIG. 3 illustrates a cross-section of the loudspeaker apparatus 10 as viewed along the direction and plane indicated by "A" in FIG. 1, whereas FIG. 4 shows a cross-section of the loudspeaker apparatus 10 as viewed in the opposite direction to that indicated by "A" in FIG. 1.

As best illustrated in FIGS. 3 and 4, the loudspeaker apparatus 10 is arranged to affect the output of the loudspeaker apparatus 10 differentially. For example, the loudspeaker apparatus is arranged to disperse sound differentially (referred herein as 'differential acoustic dispersion'), that is so that the pattern of the output sound downstream 122 from the loudspeaker apparatus 10 is varied in a prescribed manner, for example such that the sound beamwidth changes with vertical elevation relative to a horizontal plane normal to the loudspeaker apparatus 10.

The shape of the horn 30 is arranged asymmetrically about the downstream direction 122, such that a differential acoustic dispersion pattern is formed downstream of the loudspeaker apparatus 10. The passage 40 formed by the horn 30 is narrower at one-half of the horn mouth 50 than the other half of the horn mouth 50. FIG. 3 shows the loudspeaker apparatus as viewed towards the narrower portion 140 of the horn 30.

The narrower portion 140 of the horn 30 is typically located below—that is, closer to the desired plane of projection of the loudspeaker apparatus 10 (as described with reference to FIG. 7)—a wider portion 150 of the horn 30. There is a smooth transition from the narrower 140 to the wider 150 portion of the horn 30.

The shaping of the horn 30 to effect differential acoustic dispersion produces a triangle-like projection that is wider at the (bottom) narrower portion of the horn 140 and narrower at the (upper) wider portion 150 of the horn 30 than is otherwise achievable. The differential acoustic dispersion pattern allows the output of the loudspeaker apparatus 10, off of the axis of the downstream direction 122, to be substantially as wide at the short-throw distance (nearer the loudspeaker speaker apparatus 10) as it is at the long-throw distance (further away from the loudspeaker apparatus 10).

Figure 13:
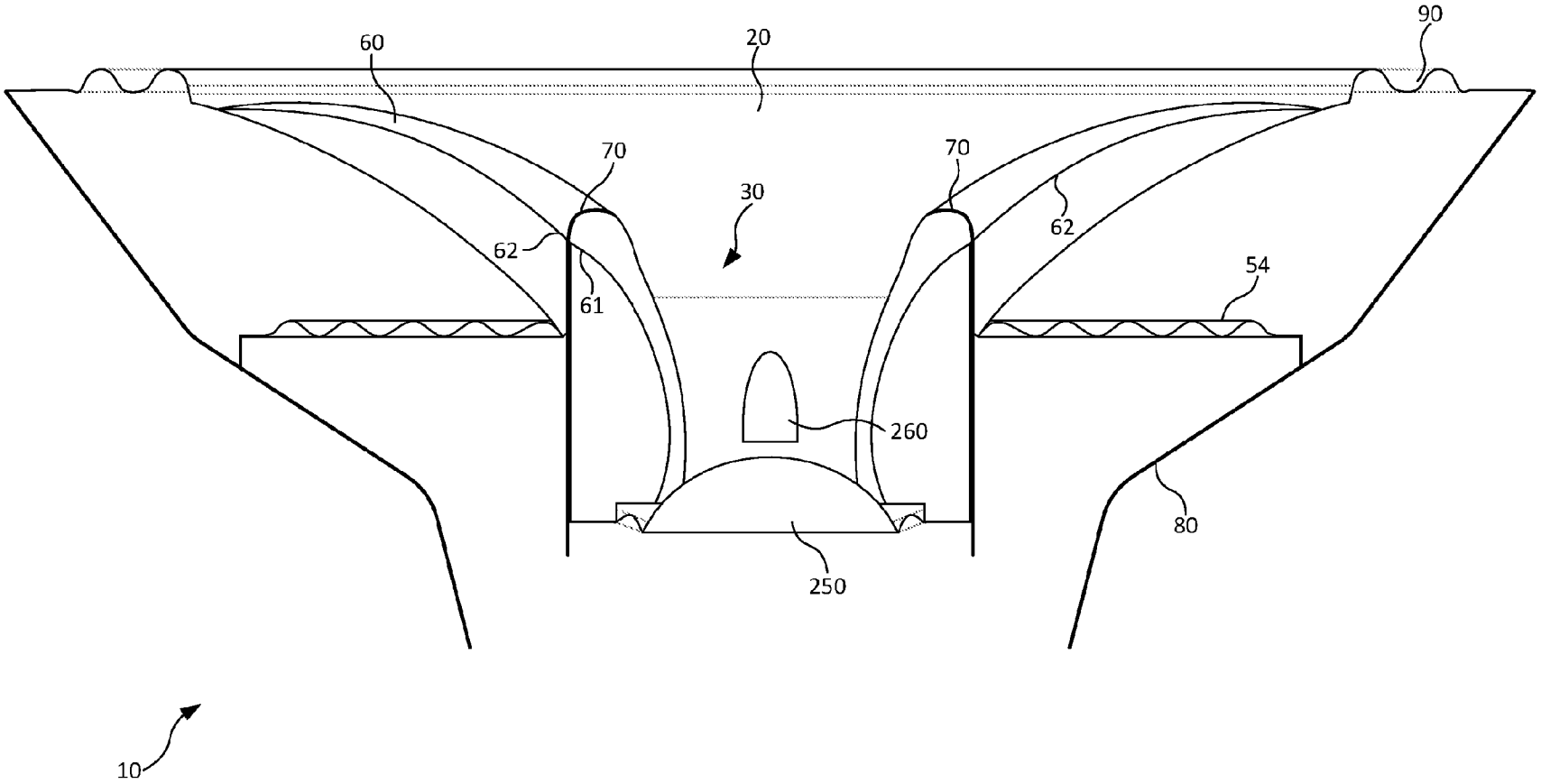
FIG. 13 shows an alternative form of the coaxial loudspeaker apparatus.

Given that the moving waveguide 60 is also used to structure the sound projection from the horn 30, the waveguide surface is shaped to control the acoustic patterning, directivity and dispersion of the output from the horn 30. The moving waveguide 60 is asymmetrically shaped such that the waveguide provides narrower acoustic dispersion towards the wider portion 150 of the horn 30 and wider acoustic dispersion towards the narrower portion 140 of the horn 30. This is achieved by varying the angle $\alpha$ formed by the moving waveguides 60 so that it is larger where wide acoustic directivity is desired and smaller where narrow acoustic directivity is desired and iteratively optimising the resultant surface to achieve the directivity that is sought. For example, the resulting moving waveguide 60 may have a tapered peak and an inwardly curving base. Exemplary forms of moving waveguides 60 are illustrated in FIG. 13.

Accordingly, FIGS. 3 and 4 best illustrate the manner in which the loudspeaker apparatus is arranged in order to achieve differential acoustic dispersion, wherein FIG. 3 shows a cut-through of the loudspeaker apparatus 10 viewed towards the narrower portion 140 of the horn 30 (i.e. as indicated by "A" in FIG. 1), whereas FIG. 4 shows the loudspeaker apparatus 10 viewed towards the wider portion 150 of the horn 30 (i.e. in the opposite direction to that indicated by "A" in FIG. 1).

Figure 5:
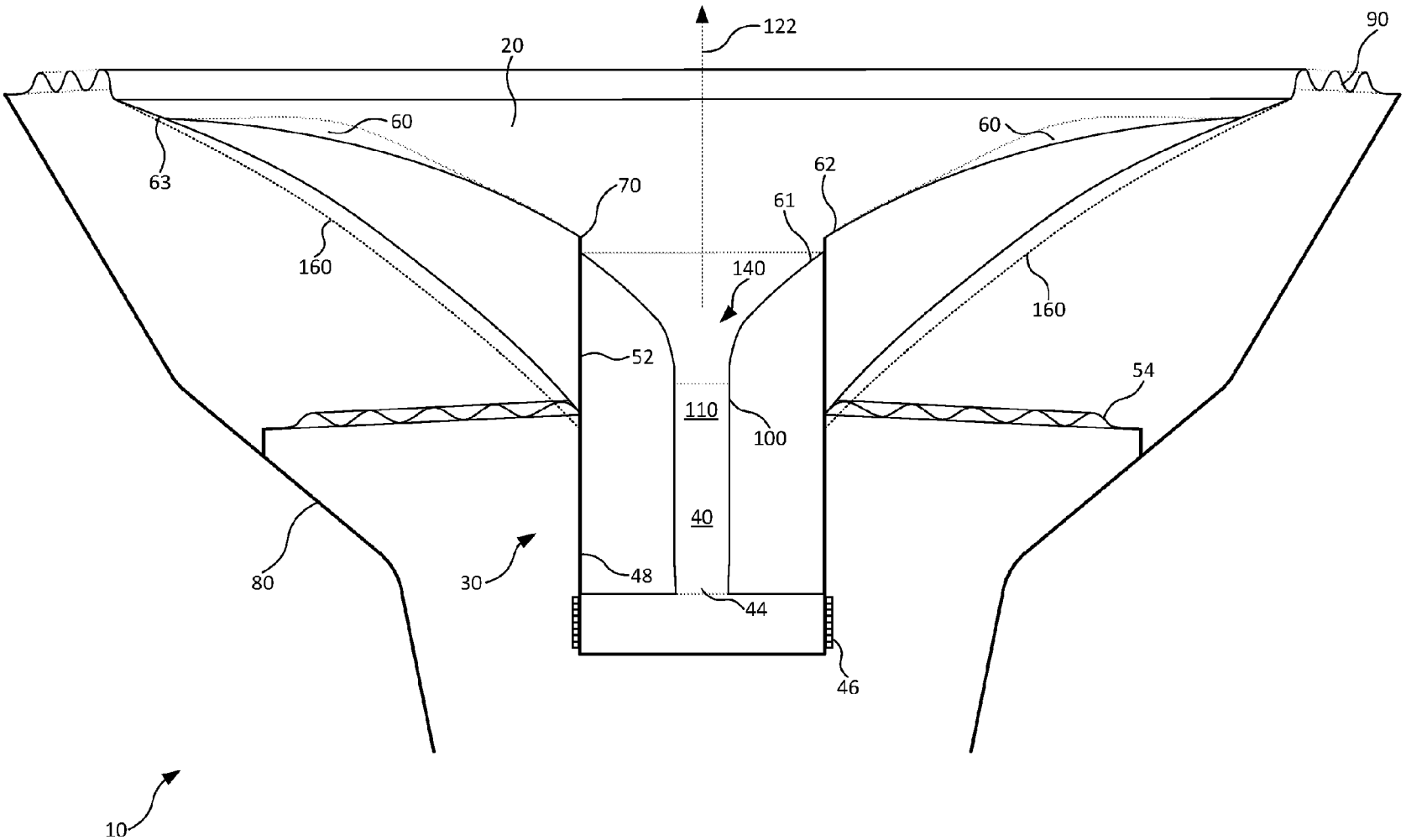

FIG. 5 shows the loudspeaker apparatus 10 in the cross-sectional view shown in FIG. 3 when the cone 20 is in a state where it is being driven by the low/mid-frequency voice coil 46. The cone 20 is therefore shifted in the downstream direction 122 relative to its rest position 160, as the moving waveguide 60 is free to move relative to the horn 30. The junction 70 between the moving waveguide 60 and horn 30 remains, but is extended, as the moving waveguide 60 is shifted with the movement of the cone 20, but the horn 30 remains fixed.

The resulting acoustic effect due to changes to the junction 70 as the moving waveguide 60 moves with the cone 20 is similar to that for a conventional coaxial drive unit.

Figure 6:
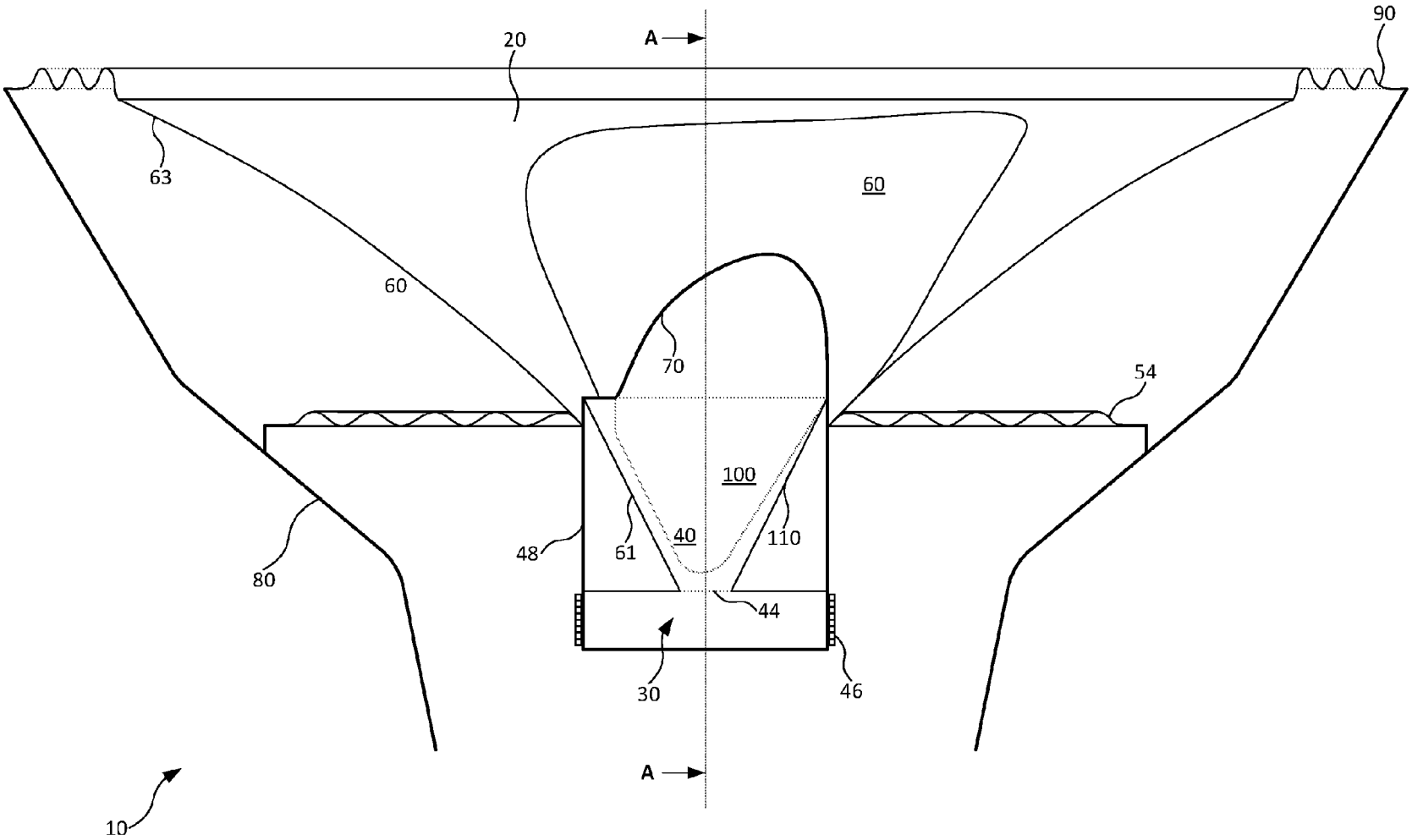

FIG. 6 shows a cross-section of the loudspeaker apparatus 10 along the line "B" shown in FIG. 1 such that the moving waveguide 60 and one of the walls 100 of the horn 30 are visible face-on. The horn 30 and junction 70 extend further along the downstream direction 122 in the plane shown in FIG. 6 than that shown when viewed from the perspectives of FIG. 4, as the extended horn-waveguide continuum is shown face-on.

As illustrated in FIGS. 1 to 6, the moving waveguides 60 can be considered to form a continuation of the horn 30 resulting in a larger single horn (albeit in two separate parts) extending from the throat 44 to the point where the moving waveguide 60 meets with the surface of the cone 20 in the downstream direction 122.

Figure 7:
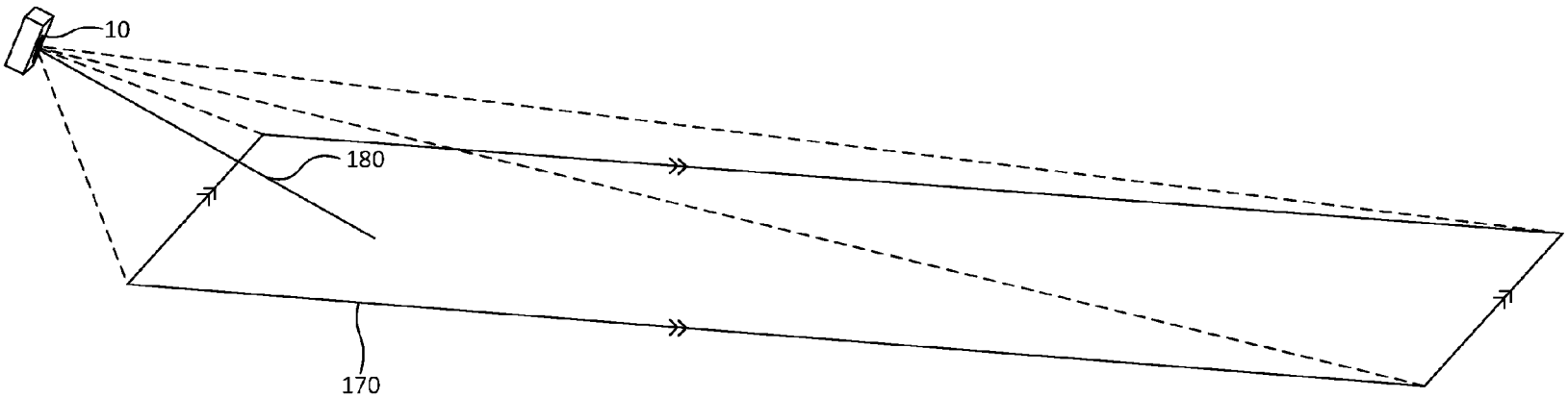
FIG. 7 is a typical application of the coaxial loudspeaker apparatus, showing a listening plane where differential acoustic dispersion is a desirable attribute.

FIG. 7 shows a downstream plane of projection 170 of the loudspeaker apparatus 10 which is arranged to achieve differential dispersion. A precise and controlled spreading-out of sound waves from the loudspeaker apparatus 10 is achieved, so as to form a prescribed output pattern of the loudspeaker apparatus 10. The loudspeaker apparatus 10 is for example flown from a support structure, mounted on a pole or on a wall such that it is raised above listener's ears and angled downwards.

A vertical elevation dependent horizontal beamwidth reduces above an axis normal to the baffle 180 and increases below the axis normal to the baffle 180; as such, a rectangular plane of projection 170 is covered.

A plurality of loudspeaker apparatus 10 are adjacently arranged according to FIG. 7 in order to provide rectangular strips of sound coverage to an audience of listeners, thereby improving the off-axis sound reproduction from the speaker, improving efficiency in the distribution of sound by preventing overlap and ensuring an even frequency and SPL response throughout the plane of projection 170 of the loudspeaker apparatus 10.

Figure 8:
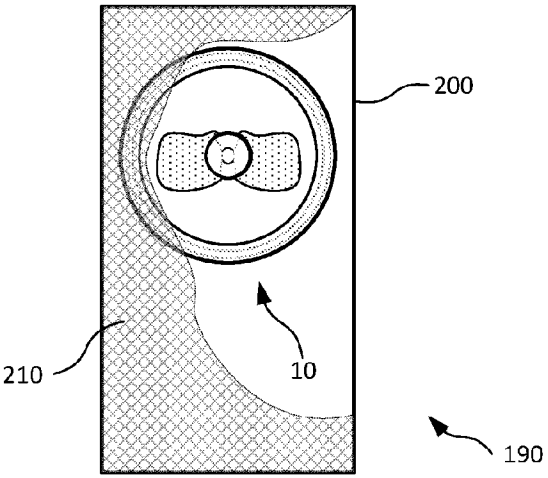
FIG. 8 illustrates the coaxial loudspeaker arrangement in a loudspeaker cabinet or encasing.

FIG. 8 is a representation of a loudspeaker 190 that includes the loudspeaker apparatus 10 within a loudspeaker cabinet or enclosure 200, as shown through a cut-away of a grille or cover 210.

The loudspeaker apparatus 10 is connected, via interfaces integrated into the cabinet or enclosure 200, to a power supply (in the case of a powered loudspeaker apparatus) and/or audio inputs. The loudspeaker enclosure 200 has brackets or fastening means, such as clasps, by which it can be flown from a suitable support, mounted on a pole or a wall and elevated and angled accordingly.

Figure 9:
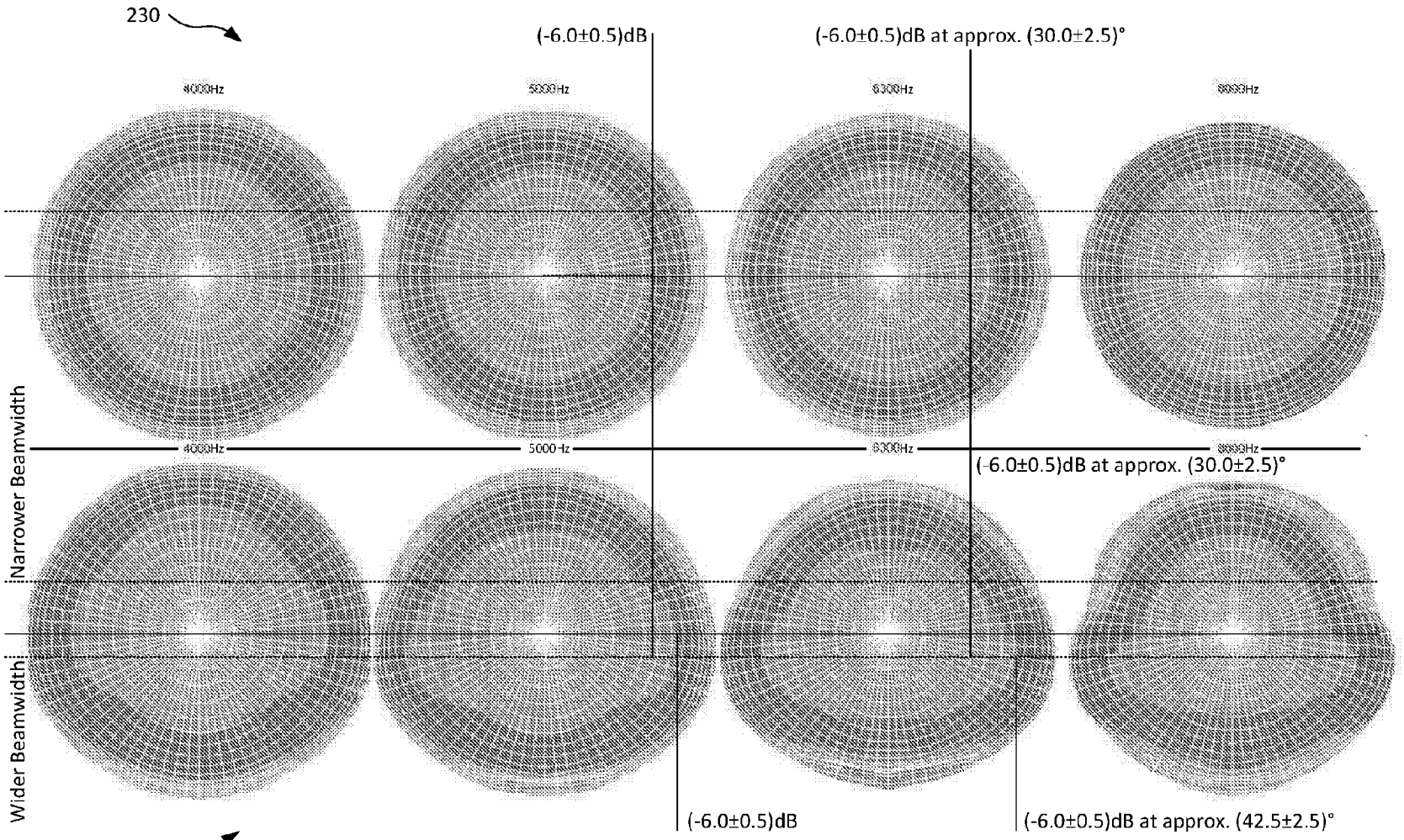
FIG. 9 is a Sound Pressure Level (SPL) contour plot showing a sphere in front of the loudspeaker across a range of frequencies and comparing a high frequency unit of the coaxial loudspeaker apparatus with a loudspeaker arrangement known in the art.
Figure 10:
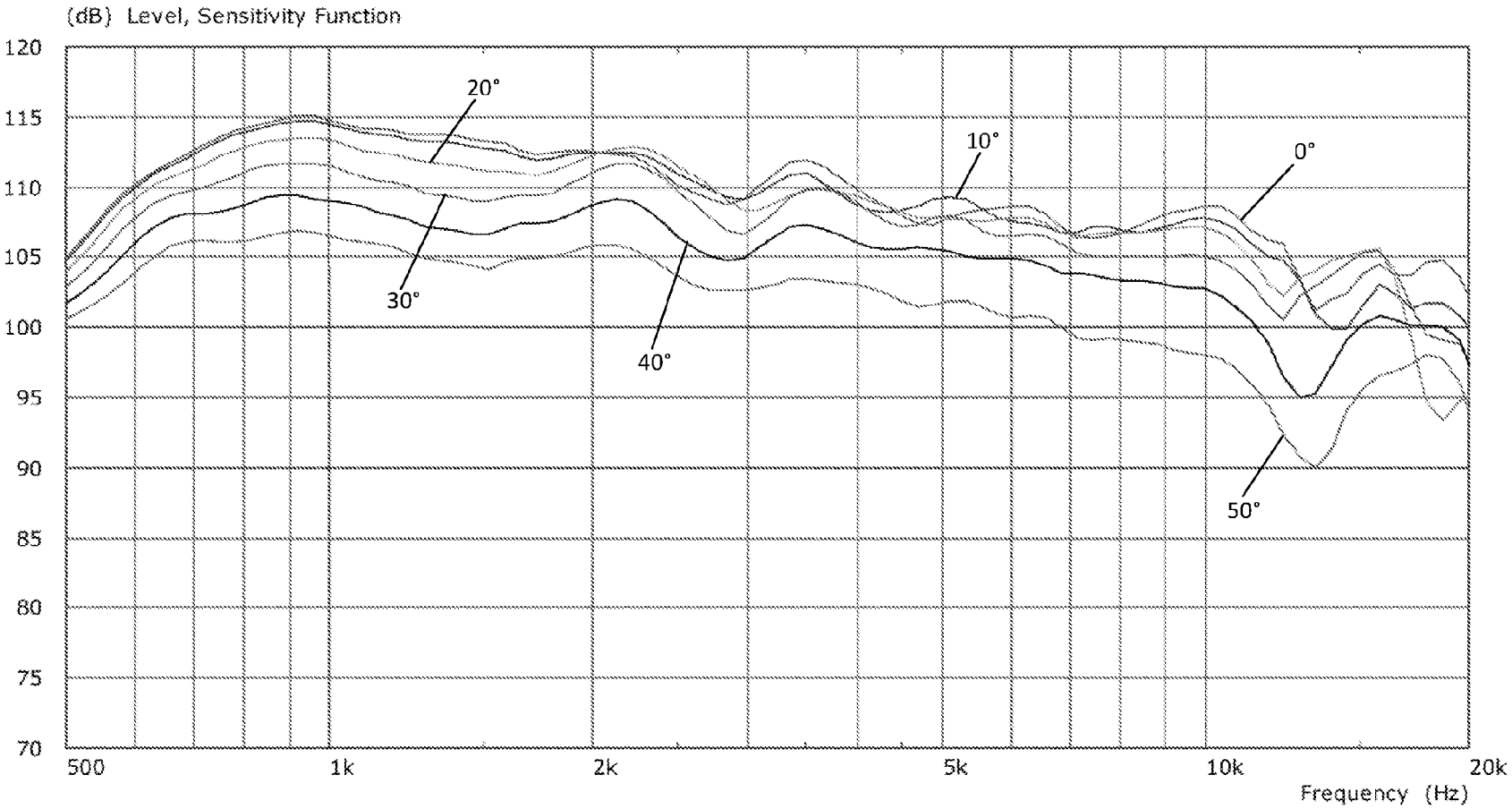
FIG. 10 shows a further plot of SPL, with frequency, of the high frequency unit of the coaxial loudspeaker apparatus.

FIGS. 9 to 11 show various plots of the acoustic response of the loudspeaker apparatus 10, in particular in comparison to loudspeakers known in the art. The drawings thereby illustrate the substantially constant beamwidth achieved by the coaxial loudspeaker 10 across a range of frequencies and off-axis angles.

In more detail, FIG. 9 shows a contour plot of the Sound Pressure Level (SPL), across a range of frequencies, over a hemisphere in front of the loudspeaker apparatus 220 (which is also arranged to achieve differential acoustic dispersion) and a conventional coaxial loudspeaker 230 known in the art. Each shade change represents a 6 dB reduction in SPL compared to the axial SPL.

As shown in FIG. 9, the presence of the moving waveguides 60 in the loudspeaker apparatus 10 improves the distribution of sound from the horn 30, thereby improving the response of the loudspeaker apparatus 10 off-axis (i.e. parallel to the propagation axis 122); this effect manifests itself more strongly at a lower frequency (preferably, in particular down to frequencies where the human ear is most sensitive (notably to volume), such as 4,000 Hz-8,000 Hz) than is otherwise achievable, for example when using a conventional loudspeaker with no moving waveguide.

By incorporating an asymmetric form of the loudspeaker apparatus 10 (so as to achieve differential dispersion) in addition to the moving waveguide 60, the effects of the moving waveguide 60 and differential acoustic dispersion form complement one another so as to improve the off-axis response of the loudspeaker apparatus 10 further.

The improved off-axis response achieved by the loudspeaker apparatus 10 is visualised in FIG. 9, where SPL drops off more gradually off axis than the SPL response of a conventional coaxial loudspeaker 230, for example the loudspeaker apparatus 10 maintains a beamwidth (6 dB reduction in SPL) that, below the horizontal axis, is approximately 20° wider than that of the conventional coaxial loudspeaker; it can therefore be seen that, above the horizontal axis, the beamwidth is reduced as required for differential acoustic dispersion performance.

FIG. 10 is a plot of the SPL response from the loudspeaker apparatus 10 (in particular, the loudspeaker apparatus 10 having, approximately, a 31 cm-38 cm diameter cone 20). The SPL response is indicated across a range of angles relative to the axis of the downstream direction 122, wherein at zero degree the response is shown on the axis of the downstream direction; the SPL response of the loudspeaker apparatus 10 off-axis is shown for angles of 10°, 20°, 30°, 40° and 50°. Across the range of angles the plot shows that the loudspeaker apparatus 10 achieves substantially a constant beamwidth for a frequency range of 0.8 kHz-20 kHz.

Figure 11B:
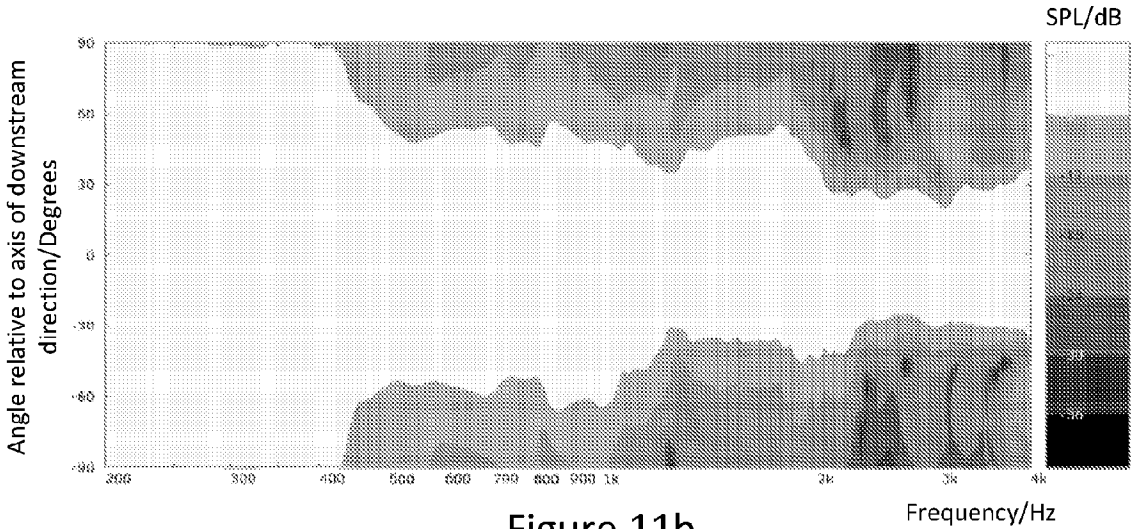
Figure 12A:
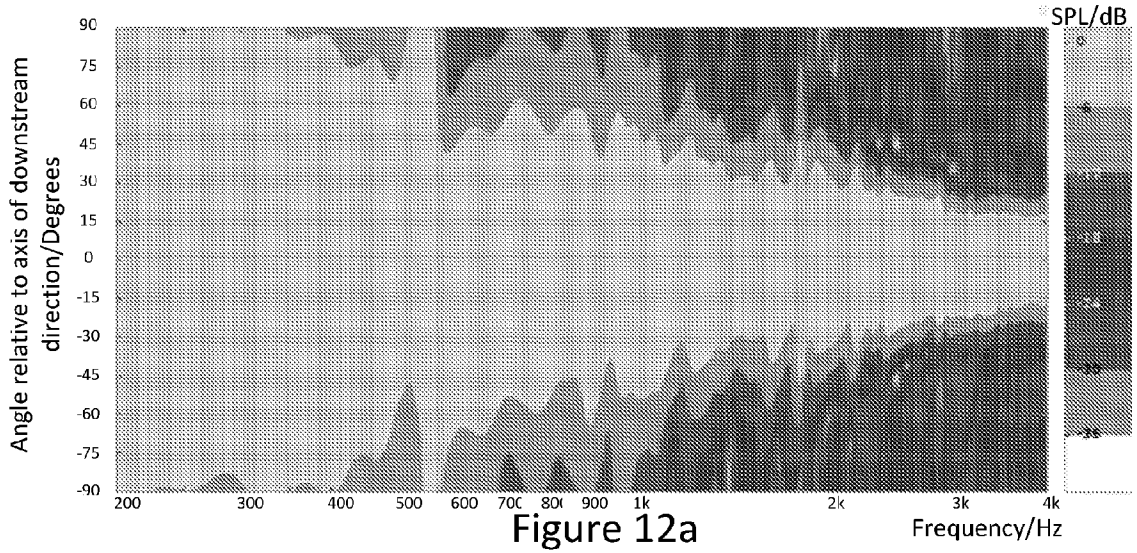
Figure 12B:
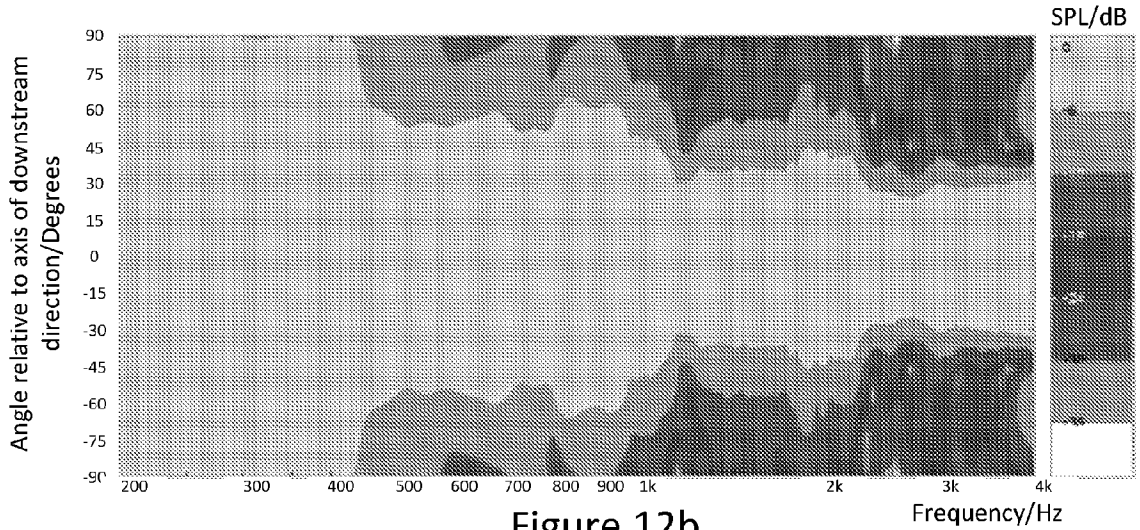

FIGS. 11*a*, 11*b*, 12*a* and 12*b* show contour plots of the SPL response with frequency across a range of angles relative to the axis of the downstream direction 122. In particular FIGS. 11*b* and 12*b* illustrate, by comparison with FIGS. 11*a* and 12*a* respectively, an improvement in the beamwidth (for example in its symmetry) from the loudspeaker apparatus 10, due to the presence of moving waveguides 60, over a loudspeaker that lacks such waveguides.

The loudspeaker apparatus 10 is arranged to affect the output of the loudspeaker apparatus 10 differentially across the output frequency spectrum (for example, such that a non-axisymmetric high frequency coverage pattern is output) and/or the output SPL with position relative to an axis perpendicular to the downstream direction 122. In one example, the shape of the moving waveguide 60 and/or the shape of the horn 30 is adapted to achieve any desired manipulation of the sound output from the horn 30 (and the cone 20), and so take any suitable form for this purpose. For example, the horn 30 is a differential acoustic dispersion horn. Other types of horn, such as, but not limited to, constant directivity, diffraction slot horns, multicell, radial, sectoral, bi-radial and twin Bessel horns are also used. The geometry of the cone 20 takes the form of a straight and/or curved, e.g. convex, (truncated) cone. In one example, the cone 20 has both straight and curved sections.

In one example, the moving waveguide 60 is coupled to the horn 30 via a rail that, in use, allows the moving waveguide to move along the rail so as to allow "to-ing and fro-ing" of the moving waveguide 60 along the junction 70, parallel to the downstream direction 122. Alternatively, the moving waveguide 60 is coupled to the horn 30 using a compliant member (for example, a hinge or a suspension similar to the suspension 90 used across the cone-frame interface) that does not alter the continuity across the junction 70 nor the ability for the moving waveguide 60 to move with the cone 20. The compliant membrane may act as a small inner surround to reduce air-leak by acting as a seal as the moving waveguide 60 is shifted with the movement of the cone 20.

FIG. 13 shows an alternative example of the loudspeaker apparatus 10, wherein the high frequency unit does not comprise a compression driver, but a convex dome 250 (or a direct radiating dome) instead, as shown in FIG. 13, preferably with a suitable phase corrector (also known as a phase plug) 260 mounted into a fixed horn 270.

Figure 14B:
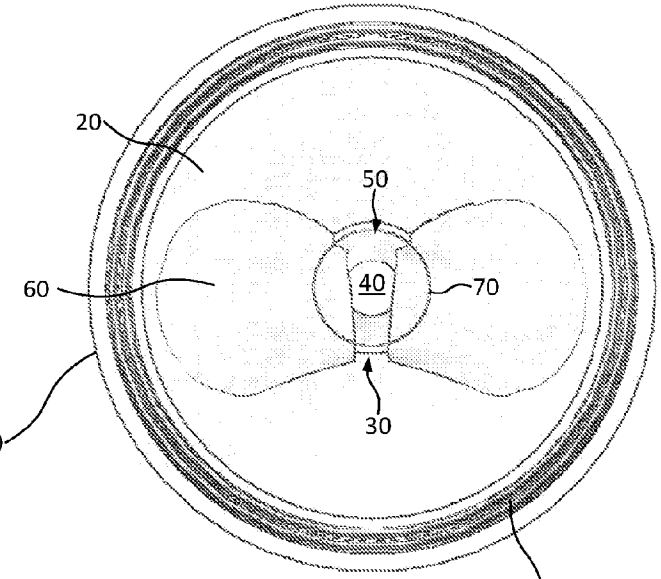
FIG. 14 show further alternative forms of the coaxial loudspeaker apparatus and in particular various shapes of moving waveguides.
Figure 14D:
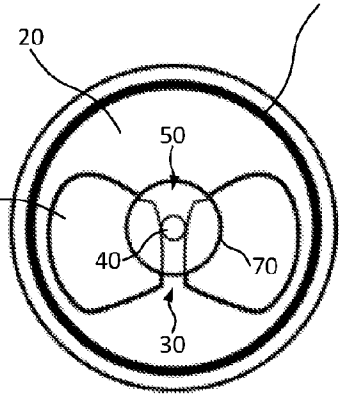
Figure 14C:
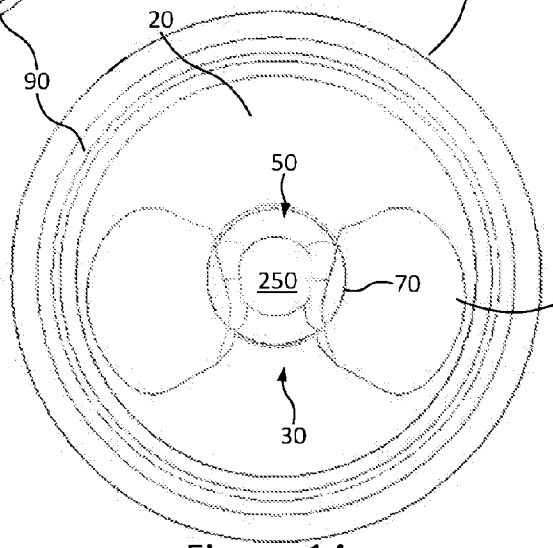
Figure 14A:
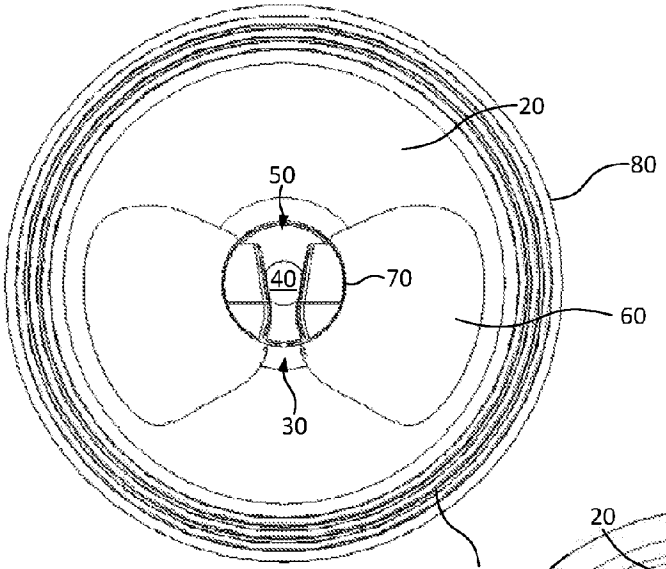

FIGS. 14*a* to 14*d* illustrate various alternatives of the loudspeaker apparatus 10, in particular the shape of the moving waveguide 60. For example, the shape of the moving waveguide 10 is adjusted according to the application of the loudspeaker apparatus and the desired acoustic output that is to be achieved. Generally, it can be seen across the variants illustrated in FIGS. 14*a* to 14*d* that a non-symmetric moving waveguide 60 is used. FIG. 14*c* shows a frontal view of the loudspeaker apparatus having a convex dome 250.

It will be understood that the present invention has been described above purely by way of example, and modifications of detail can be made within the scope of the invention.

Each feature disclosed in the description, and (where appropriate) the claims and drawings may be provided independently or in any appropriate combination.

Reference numerals appearing in the claims are by way of illustration only and shall have no limiting effect on the scope of the claims.

The invention claimed is:

1. A coaxial loudspeaker apparatus comprising:

a first unit being arranged to propagate sound in a first frequency range; and a second unit comprising a first waveguide arranged to propagate sound in a second frequency range that is higher than the first frequency range, and a second waveguide arranged to move, during operation, relative to the first waveguide, wherein the second waveguide extends substantially in prolongation of the first waveguide and is arranged to move in unison with the first unit and to result in differential acoustic dispersion in the second frequency range.

2. A coaxial loudspeaker apparatus comprising:

a first unit, comprising a cone, being arranged to propagate sound in a first frequency range;

a second unit comprising a driver unit located upstream of the cone, a first waveguide arranged to propagate sound in a second frequency range that is higher than the first frequency range, and a second waveguide arranged to move, during operation, relative to the first waveguide; wherein the second waveguide extends substantially in prolongation of the first waveguide and is arranged to move in unison with the first unit.

3. An apparatus according to claim 1, wherein the second waveguide extends substantially continuously from the first waveguide when the first unit is at rest.

4. An apparatus according to claim 1, wherein the second waveguide is arranged downstream of the first waveguide and/or the second unit is arranged downstream of the first unit.

5. An apparatus according to claim 1, wherein the second waveguide is separate from the first waveguide.

6. An apparatus according to claim 1, wherein the second waveguide is attached to the first unit.

7. An apparatus according to claim 1, wherein the second waveguide is arranged to extend the shape of the first waveguide.

8. An apparatus according to claim 1, wherein the first waveguide is a horn.

9. An apparatus according to claim 1, the first waveguide and/or the second waveguide are shaped to form a constant directivity horn.

10. An apparatus according to claim 1, wherein the shape of the first waveguide and/or the second waveguide is adapted to output a differential acoustic dispersion pattern of sound.

11. An apparatus according to claim 1, wherein the first waveguide and/or the second waveguide is non-symmetric—about an axis downstream from the coaxial loudspeaker apparatus.

12. An apparatus according to claim 2, wherein the second waveguide extends substantially continuously from the first waveguide when the first unit is at rest.

13. An apparatus according to claim 2, wherein the second waveguide is arranged downstream of the first waveguide and/or the second unit is arranged downstream of the first unit.

14. An apparatus according to claim 2, wherein the second waveguide is separate from the first waveguide.

15. An apparatus according to claim 2, wherein the second waveguide is attached to the first unit.

16. An apparatus according to claim 2, wherein the second waveguide is arranged to extend the shape of the first waveguide.

17. An apparatus according claim 2, wherein the first waveguide is a horn.

18. An apparatus according to claim 2, the first waveguide and/or the second waveguide are shaped to form a constant directivity horn.

19. An apparatus according to claim 2, wherein the shape of the first waveguide and/or the second waveguide is adapted to output a differential acoustic dispersion pattern of sound.

20. An apparatus according to claim 2, wherein the first waveguide and/or the second waveguide is non-symmetric about an axis downstream from the coaxial loudspeaker apparatus.

* * * * *